US010437199B2

(12) United States Patent
Kadmiri et al.

(10) Patent No.: US 10,437,199 B2
(45) Date of Patent: Oct. 8, 2019

(54) ATYPICAL GONG, WATCH WITH STRIKING MECHANISM COMPRISING THE SAME AND GONG MANUFACTURING METHOD

(71) Applicant: Montres Breguet S.A., L'Abbaye (CH)

(72) Inventors: Younes Kadmiri, Morre (FR); Thomas Frangne, Les Hopitaux-Neufs (FR); Davide Sarchi, Zurich (CH)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 15/420,811

(22) Filed: Jan. 31, 2017

(65) Prior Publication Data

US 2017/0248921 A1 Aug. 31, 2017

(30) Foreign Application Priority Data

Feb. 26, 2016 (EP) ..... 16157723

(51) Int. Cl.

| | |
|---|---|
| ***G04B 21/06*** | (2006.01) |
| ***G04B 21/08*** | (2006.01) |
| ***G04B 23/02*** | (2006.01) |
| ***G04B 21/12*** | (2006.01) |

(52) U.S. Cl.

CPC ..... *G04B 21/06* (2013.01); *G04B 21/08* (2013.01); *G04B 21/12* (2013.01); *G04B 23/028* (2013.01)

(58) Field of Classification Search

CPC ..... G10D 13/08; G10D 13/085; G10F 1/10; G04B 21/00; G04B 21/06; G04B 21/08; G04B 21/12; G04B 23/028

See application file for complete search history.

(56) References Cited

U.S. PATENT DOCUMENTS

| | | | | |
|---|---|---|---|---|
| 2008/0074956 | A1 | 3/2008 | Karapatis | |
| 2008/0105105 | A1* | 5/2008 | Stevens | G10D 13/08 84/423 R |
| 2008/0130423 | A1* | 6/2008 | Claret | G04B 19/065 368/309 |

(Continued)

FOREIGN PATENT DOCUMENTS

| | | |
|---|---|---|
| CH | 30758 | 1/1905 |
| CH | 702 145 A1 | 5/2011 |

(Continued)

OTHER PUBLICATIONS

Journe, Francois-Paul, English Translation of EP 1760549, originally published Mar. 7, 2007, translation retrieved on Apr. 16, 2018 from Espacenet, full document.*

(Continued)

*Primary Examiner* — Daniel P Wicklund

(74) *Attorney, Agent, or Firm* — Oblon, McClelland, Maier & Neustadt, L.L.P.

(57) ABSTRACT

The gong is made with a wire or a strip having an atypical shape for a watch striking mechanism. The gong includes a rectilinear part connected to a curved part. The rectilinear part and/or the curved part are connected to the same gong-carrier. The gong includes several notches made at defined geometric points on a portion of the length of the gong to adapt the natural vibration frequencies within an audible range between 1 kHz and 5 kHz, so that the sound produced by the vibrating gong is harmonious.

19 Claims, 3 Drawing Sheets

(56) References Cited

U.S. PATENT DOCUMENTS

| | | | | |
|---|---|---|---|---|
| 2009/0091431 | A1 | 4/2009 | Chritin et al. | |
| 2012/0140602 | A1* | 6/2012 | Favre ..... | G04B 37/0075 368/272 |
| 2014/0104994 | A1 | 4/2014 | Raggi et al. | |

FOREIGN PATENT DOCUMENTS

| | | | |
|---|---|---|---|
| CH | 708 036 | A2 | 11/2014 |
| EP | 1 760 549 | A1 | 3/2007 |
| EP | 1 906 267 | A1 | 4/2008 |
| EP | 2 720 091 | A1 | 4/2014 |
| FR | 396.538 | | 4/1909 |
| GB | 3705 | | 4/1914 |

OTHER PUBLICATIONS

European Search Report dated Jul. 29, 2016 in European Application 16157723.4, filed on Feb. 26, 2016 (with English Translation of Categories of cited documents).

* cited by examiner

ATYPICAL GONG, WATCH WITH STRIKING MECHANISM COMPRISING THE SAME AND GONG MANUFACTURING METHOD

This application claims priority from European Patent application 16157723.4 of Feb. 26, 2016, the entire disclosure of which is hereby incorporated herein by reference.

FIELD OF THE INVENTION

The invention concerns an atypical-shaped gong for a watch striking mechanism.

The invention also concerns a watch with a striking mechanism comprising at least one atypical-shaped gong.

The invention also concerns a method for making an atypical-shaped gong for a watch striking mechanism.

BACKGROUND OF THE INVENTION

Within the field of watch-making, a conventional architecture is used to make movements, which are provided with striking mechanisms, such as minute repeaters. In such embodiments, the gong or gongs used are each formed by a metal wire, which is generally circular in shape and placed in a parallel plane to the watch dial. The metal wire of each gong is generally arranged around the movement, inside the watch frame and above a plate on which the various parts of the movement are mounted. One end or several ends of each gong is/are fixed, for example by soldering, to a gong-carrier integral with the plate, for example, which may be common to all the gongs. The other end of each gong may generally be free.

The watch striking mechanism also includes at least one hammer actuated at predetermined times. The gong vibration is generated by the impact of the corresponding hammer on the gong in proximity to the gong-carrier. Each hammer generally makes a partial rotation in the plane of the gong(s) so as to strike the corresponding gong and cause it to vibrate in its plane, i.e. in an X-Y plane parallel to the back cover or dial of the watch. Part of the gong vibration is also transmitted to the plate by the gong-carrier.

With a conventional arrangement of the gong in the shape of an arc of a circle around the watch movement, it is not easy to make the sound more pure or harmonious after the hammer strikes, which often constitutes a drawback.

In minute repeater watches, to improve vibro-acoustic radiation, it is possible to envisage firstly limiting the noise from the mechanism via regulating elements, and secondly, increasing the sound level via different external elements. However, optimising the gong generating the vibrations radiated by the external watch parts is not often envisaged.

As indicated above, the gong generally takes the shape of an arc of a circle disposed around the watch movement or above said watch movement. A vibration frequency is adapted according to the dimensions of the gong, namely its length and cross-section, and the material of which it is composed.

However, the intrinsic frequencies of each vibrating gong are not properly controlled, since the harmonics, which compose the vibrating gong, are not in tune with each other. Thus, when a corresponding hammer strikes, the gong or gongs of the striking mechanism generate a sound with some dissonance, and thus with an inharmonious sound, which constitutes a drawback.

CH Patent Application 708 036 A2, which discloses a timepiece striking device with at least one gong made of titanium or titanium alloy, can be cited in this regard. Two vibrating gongs may be provided, which are each struck by a corresponding hammer. One of the gongs includes several through holes or blind hollows in defined positions over its length in order to obtain the desired musical height and sound duration. The gongs are configured as portions of a circle. However, nothing is described in regard to the tuning of several main vibration frequencies of each gong to obtain a harmonious sound and a sufficient number of partials in the audible range according to the dimension of the gong, which constitutes several drawbacks.

U.S. Pat. No. 3,013,460 discloses a musical comb with a certain number of strips, which are all connected to a heel portion in one piece with the strips. The comb can be fixed on a plate by screws, which pass through apertures in a covering plate on the top of the heel portion, and apertures in the heel portion. The thickness of the strips is adjusted by a grinding wheel, which can be moved from the heel portion and over a portion of each strip to adjust the melody of the musical comb. A cover of the plate serves to conceal the machined portions of each strip. However, nothing is described in regard to the tuning of several main vibration frequencies of each strip to obtain a harmonious sound, which constitutes a drawback.

U.S. Pat. No. 7,746,732 B2 discloses a gong for a striking device. This gong can be configured, between its attachment to a gong-carrier and its freely moving end, with a cross-section that increases or with continuous variations in cross-section along its entire length so as to increase the richness and quality of the sound emitted when the gong is struck. Like the preceding documents, nothing is described concerning how to tune several main vibration frequencies of the gong to obtain a harmonious sound, which constitutes a drawback.

SUMMARY OF THE INVENTION

It is thus an object of the invention to overcome the drawbacks of the prior art by providing an atypical shaped gong for a watch striking mechanism, to produce more easily audible vibrations and with a harmonious sound without dissonance.

To this end, the invention concerns an atypical shaped gong for a striking mechanism of a watch, the gong in the form of a wire or a strip including a rectilinear part connected to a curved part, wherein the gong includes at least two notches or hollows or grooves at defined geometric points on a portion of the length thereof so as to adapt at least two natural vibration frequencies within an audible range between 1 kHz and 5 kHz, and wherein the ratio between these two frequencies is a number N+d, where N is an integer number greater than or equal to 2, and d/N is comprised between −0.01 and +0.01, so that the sound produced by the vibrating gong is harmonious.

Specific embodiments of the gong are defined in the dependent claims 2 to 9.

One advantage of the atypical or unusual gong for a striking mechanism according to the invention lies in the fact that it is configured to ensure consonant harmonic and melodic intervals. The gong includes geometric tuning points, which are preferably notches arranged along the gong. The gong can include at least two notches made at defined places on its length. Preferably, once the gong is mounted inside the watch case, these notches are made on a part that is not visible from outside the watch case.

Advantageously, more than two notches can be made on a part of the gong not visible from the outside to allow for fine adjustment of several frequencies. Thus, at least two frequencies, or even three or four or more frequencies can be adjusted depending on the number of notches. With the notches made and arranged at well-defined places on the length of the gong, it is possible to increase the number of partials of the vibrating gong within the audible range from 0 to 5 kHz, even with a shorter than usual gong. Frequencies above 5 kHz can add intensity, richness and brightness to the sound. It is possible to finely adjust the frequencies manually or automatically with the aid of a machining robot by making these notches.

Advantageously, it is possible to configure said gong to ensure main vibration frequencies that are well in tune with each other. These tuned frequencies can be defined according to Western or Oriental or African music chords.

Advantageously, the gong may comprise at least one rectilinear part and one curved part. At least one end of the gong is intended to be attached to a gong-carrier, but it is possible to envisage having both ends of the gong attached to the same gong-carrier. At least one notch is made on the rectilinear part and another notch is made on the curved part. Further, the curved part may have a portion modified to aesthetically represent the letter B. This aesthetic appearance may be required, given that the gong is visible from outside the watch case through the watch crystal.

To this end, the invention also concerns a striking watch including a striking mechanism provided with at least one gong of atypical shape, the striking mechanism including at least one gong-carrier, to which the gong is connected, and at least one hammer capable of striking, at determined moments, the gong from below in a vertical direction substantially perpendicular to the plane including the gong, the gong-carrier being integral with a plate or disposed in contact with an inner wall of a case middle or a bezel or a watch case back.

Specific embodiments of the watch are defined in the dependent claims 11 to 14.

Advantageously, with the configured atypical shaped gong of the striking mechanism mounted inside the watch case, it is also possible to obtain an improvement in the sound level of the watch within the audible range. It is thus possible to tune the partials of the gong or gongs to the natural frequencies of the external parts. Further, the creation of notches in the gongs ensures uniformity of melodic tuning among all the watches that are manufactured.

Advantageously, the striking mechanism comprises two gongs each attached to a gong carrier and tuned differently from each other in order to each generate a specific sound to indicate the hours or the minutes. Each gong may have at least two notches over its length in order to produce a harmonious sound. The gongs are mounted parallel to the dial and underneath the watch glass so as to be visible through the watch crystal. The gong notches are thus made on a surface that is not visible from outside the watch.

The invention also concerns a method for manufacturing at least one atypical shaped gong, for a striking mechanism of a watch, wherein the method includes the steps of

- determining the active lengths of the rectilinear part and of the curved part of the gong by dimensioning each part independently of the other to produce natural frequencies close to selected target values when the gong vibrates,
- refining the natural frequencies of the gong by forming notches or hollows or grooves in an undersurface of the gong at defined geometric points on the length of the gong to produce a harmonious sound from the vibrating gong.

Particular steps of the gong manufacturing method are defined in the dependent claims 16 and 17.

BRIEF DESCRIPTION OF THE DRAWINGS

The objects, advantages and features of the atypical-shaped gong for a watch striking mechanism, and of the watch with a striking mechanism will appear more clearly in the following description, particularly with reference to the drawings, in which.

DETAILED DESCRIPTION OF THE INVENTION

In the following description, all those elements of the watch with a striking mechanism, which includes at least one gong intended to be struck by a hammer, which are well known in this technical field, will be only briefly described.

Figure 1:
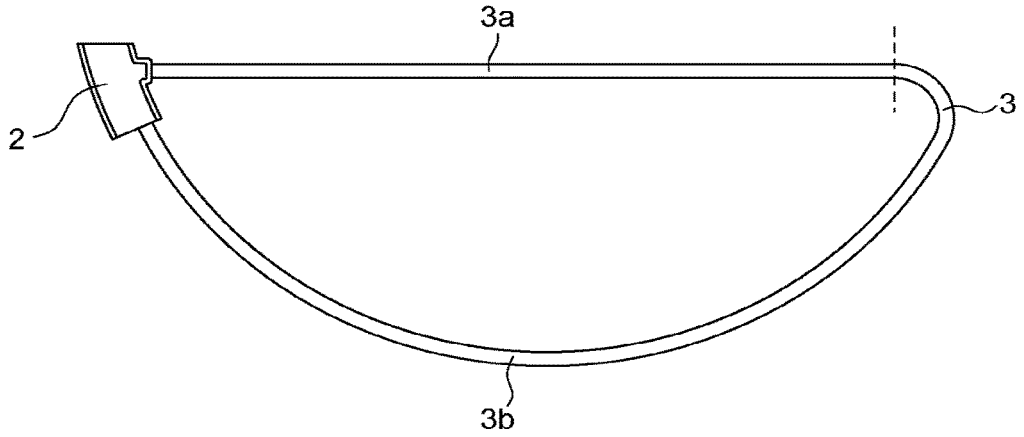
FIG. 1 is a top view of an embodiment of an atypical-shaped gong of a striking mechanism, with vibration frequency adaptation according to the invention.

FIG. 1 shows an embodiment of an atypical-shaped gong 3, which normally forms part of a watch striking mechanism (not represented). Gong 3 takes the form of a wire or strip of a certain length, width and thickness. Gong 3 is configured and made to be capable of producing a harmonious sound without dissonance, when it is struck by a hammer of the striking mechanism. Gong 3 is shown in a top view, as it can be seen, for example, through a watch crystal. It may be attached by one of its ends to a gong-carrier 2 of the striking mechanism, or as shown, attached by both ends to gong-carrier 2. Gong 3 comprises a rectilinear part 3*a* connected to a curved part 3*b*, which may be of partially circular shape. Dashed lines in the Figures show the connection boundary between rectilinear part 3*a* and curved part 3*b*. Rectilinear part 3*a* and curved part 3*b* are preferably in the same plane, which may be parallel to the watch dial once mounted.

Gong 3 may be obtained from a moulding or wire rolling or wire cutting operation or by stamping a plate of metal material in a machining device. Gong 3 can be made in one-piece with gong-carrier 2, but may also be secured by welding or soldering to said gong-carrier 2. Preferably, the gong has a rectangular cross-section, but may also be circular. Preferably, the cross-section is identical throughout the length of the gong prior to adjustment of the vibration frequencies. The gong can be made of amorphous metal or metallic glass, or also of gold or platinum, or even of brass, titanium, aluminium or another material or metal alloy with a similar density, Young's modulus and elastic limit. The metallic glass may, for example, be made from a base of zirconium, gold, platinum, or gold with palladium, platinum and silver or another metal capable of solidifying in amorphous form.

Figure 2:
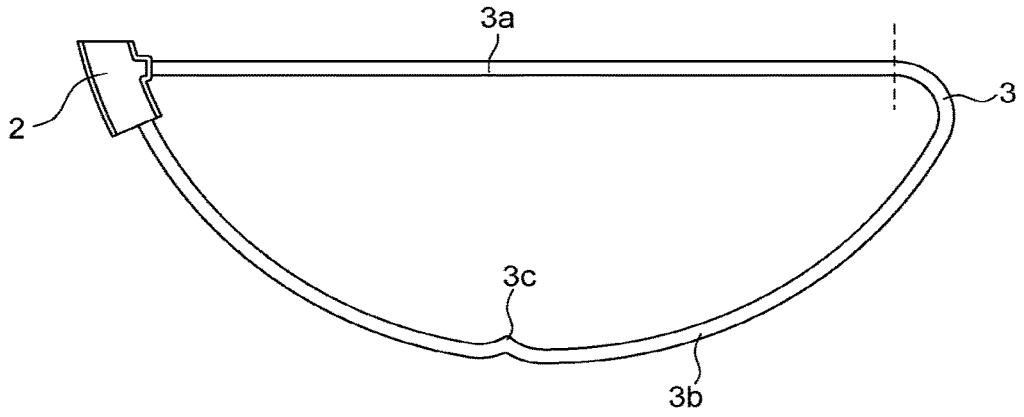
FIG. 2 is a top view of an embodiment of the gong represented in FIG. 1 with a modified portion from an aesthetic point of view according to the invention.

As shown in FIG. 2, gong 3 may also comprise a modified portion 3*c* made on curved part 3*b*. This modified portion 3*c* is made on a median portion of curved part 3*b* to represent a letter seen from above, for example a B. This B-shaped gong can be seen through the watch crystal once mounted inside the watch case and defines a symbol of the watch brand.

The dimensioning of this type of gong 3 with a rectilinear part 3*a*, curved part 3*b* and possibly modified portion 3*c* on curved part 3*b* occurs in three main production steps.

The first step consists in determining the active lengths of the gong independently of each other so that the parts can produce natural frequencies, which are close to target values selected for the desired musical tuning. To achieve this, rectilinear part 3*a* is dimensioned alone, and curved part 3*b* is also dimensioned alone. The two parts 3*a* and 3*b* joined together give the roughly dimensioned gong 3. The two parts 3*a* and 3*b* can be connected to the same gong-carrier 2, but it is also possible to have only rectilinear part 3*a* connected to gong-carrier 2 or curved part 3*b* connected to gong-carrier 2.

The second step consists in slightly modifying the shape of the gong to define a particular structure with a desired aesthetic appearance. This particular structure may be the shape of a letter, such as the letter B representing a symbol of a watch brand. In this regard, as previously mentioned, a modified portion 3*c* is made on curved part 3*b*, for example on a median portion of said curved part 3*b*.

Figure 3:
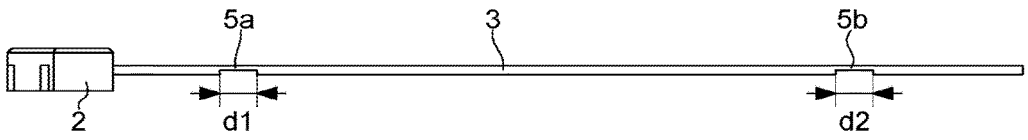
FIG. 3 is a transverse view of the gong of FIG. 2 notably of the rectilinear part showing the fine adjustment notches for several frequencies to produce a harmonious sound according to the invention.

Finally, the third step consists in refining the natural frequencies of gong 3 by making notches 5*a*, 5*b*, as represented in FIG. 3, or hollows or grooves. Notches 5*a* and 5*b* represented in FIG. 3 are made in rectilinear part 3*a*, but other notches or hollows or grooves can also be made on curved part 3*b*. These notches 5*a* and 5*b* are made on an undersurface of gong 3, so as not to be directly visible through a watch crystal once the gong is mounted inside the watch case.

Each notch 5*a*, 5*b* is machined, notably by milling, by a machining robot programmed to define a hollow of a certain depth in the thickness of the gong and over the entire width of the gong. The first notch 5*a* or groove can be machined over a length d1 in rectilinear part 3*a* of the gong and to a defined depth in the general thickness of the gong. The second notch 5*b* can be machined over a length d2 in rectilinear part 3*a* of the gong and to a defined depth in the general thickness of the gong. The two notch depths may preferably be similar, but it is possible to envisage making them with a different depth in the general thickness of the gong. The two notches 5*a*, 5*b* can be machined over the entire width of gong 3.

It it is to be noted that notches 5*a*, 5*b* or hollows or grooves reduce the local stiffness of gong 3. The duration of vibration of gong 3 after a strike by a hammer is also increased, without thereby reducing resistance to external shocks, which is advantageous. As shown, the first notch 5*a* in rectilinear part 3*a* is made close to gong carrier 2, whereas second notch 5*b* is made close to the connection of rectilinear part 3*a* to curved part 3*b*. Notches 5*a*, 5*b* or hollows or grooves allow the gong frequencies to be finely tuned to obtain the desired frequencies and at geometric points, which are the nodes and/or antinodes of certain natural frequencies of the gong.

This also makes it possible to significantly increase the number of partials of a vibrating gong within the audible range without thereby modifying its size, i.e. its length. The sound produced by the gong vibration and radiated by the external watch parts can then be true and rich from the melodic point of view.

In the conventional and simple prior art geometries for dimensioning a gong, there can be no selective tuning of the frequencies produced by the gong. A geometric modification causes a significant overall drift, for example more than 100 Hz, of all the frequencies produced, or of most of such frequencies.

As a non-limiting example of the dimensioning and tuning of such a gong, the gong is configured to produce, for example, a note similar to an F sharp. To produce this tonality within a multi-frequency sound, gong 3 must have natural frequencies equal to at least 1480 Hz, which corresponds to the note F sharp 5 and 2960 Hz, which corresponds to the note F sharp 6 as shown in the table below.

Of course, other musical notes can be selected according to the length, width and thickness of gong 3, its shape and the material of which it is composed. It is possible to ensure that the main vibration frequencies of gong 3 are in tune with each other in Western music chords, i.e. C minor, C major, D major, G major, or other, or also in Oriental or African music.

Although not represented by the Figures for a gong 3, it is possible to define the mode shape and frequency of one of the natural frequencies of rectilinear part 3*a* and those of curved part 3*b* of the gong. This is defined for the simply supported boundaries conditions at the free end of the two parts 3*a*, 3*b*, so that there is mode shape continuity, i.e. with a node present at the end. The geometry of these two parts 3*a*, 3*b* is independently optimised so that their frequencies are close to the desired frequency. With gong 3 formed by rectilinear part 3*a* and curved part 3*b* both connected to gong-carrier 2, the mode shape of rectilinear part 3*a* may have two antinodes, whereas the mode shape of curved part 3*b* may have three antinodes. In these conditions, a notch can be provided on each antinode of the mode shape of each part of gong 3.

The procedure described above is reproduced to obtain another natural frequency, which is close to the desired frequency of 2960 Hz. By way of example, the following table sets out natural frequencies within the audible range of a gong according to FIG. 1 without a modified portion and without notches, according to FIG. 2 with modified portion 3*c* but without notches, and according to FIGS. 2 and 3 with modified portion 3*c* and notches 5*a*, 5*b*.

| In Hz | Gong without modified portion and without notches | Gong with modified portion and without notches | Gong with modified portion and notches |
|---|---|---|---|
| $f_1$ | 85 | 85 | 62 |
| $f_2$ | 268 | 270 | 227 |
| $f_3$ | 562 | 563 | 431 |
| $f_4$ | 884 | 886 | 659 |
| $f_5$ | **1529** | **1532** | 1205 |
| $f_6$ | 1967 | 1975 | **1471 = F#5** |
| $f_7$ | **2880** | **2900** | 2567 |
| $f_8$ | 3554 | 3554 | **2961 = F#6** |
| $f_9$ | 4602 | 4621 | 3502 |
| $f_{10}$ | 5632 | 5613 | 4750 |
| $f_{11}$ | 6737 | 6720 | 5391 |
| $f_{12}$ | 8125 | 8148 | 7443 |
| $f_{13}$ | 9357 | 9358 | 7988 |
| $f_{14}$ | 10964 | 10912 | 9100 |
| $f_{15}$ | 12488 | 12177 | 11125 |
| $f_{16}$ | 14134 | 14027 | 12040 |
| $f_{17}$ | 15798 | 14513 | 12112 |
| $f_{18}$ | 16473 | 16633 | 12949 |

-continued

| In Hz | Gong without modified portion and without notches | Gong with modified portion and without notches | Gong with modified portion and notches |
|---|---|---|---|
| $f_{19}$ | 17104 | 17202 | 13340 |
| $f_{20}$ | 18478 | 19206 | 14964 |
| $f_{21}$ | — | — | 15133 |
| $f_{22}$ | — | — | 16512 |
| $f_{23}$ | — | — | 17483 |
| $f_{24}$ | — | — | 18250 |
| $f_{25}$ | — | — | 18651 |
| $f_{26}$ | — | — | 19654 |

As previously mentioned, the notches or hollows or grooves allow for fine tuning of the gong frequencies to obtain the desired frequencies. These are the frequencies marked in bold in the above table. A significant increase in the number of partials of a gong within the audible range is also obtained as shown in the 3rd column of the table, notably between 0 and 5 kHz, since the tonality of the sound is determined by its frequency content within this audible range. For frequencies higher than 5 kHz, this adds intensity, richness and brightness to the sound. This allows the gong to vibrate with a harmonious, melodic sound and without dissonance.

Figure 4:
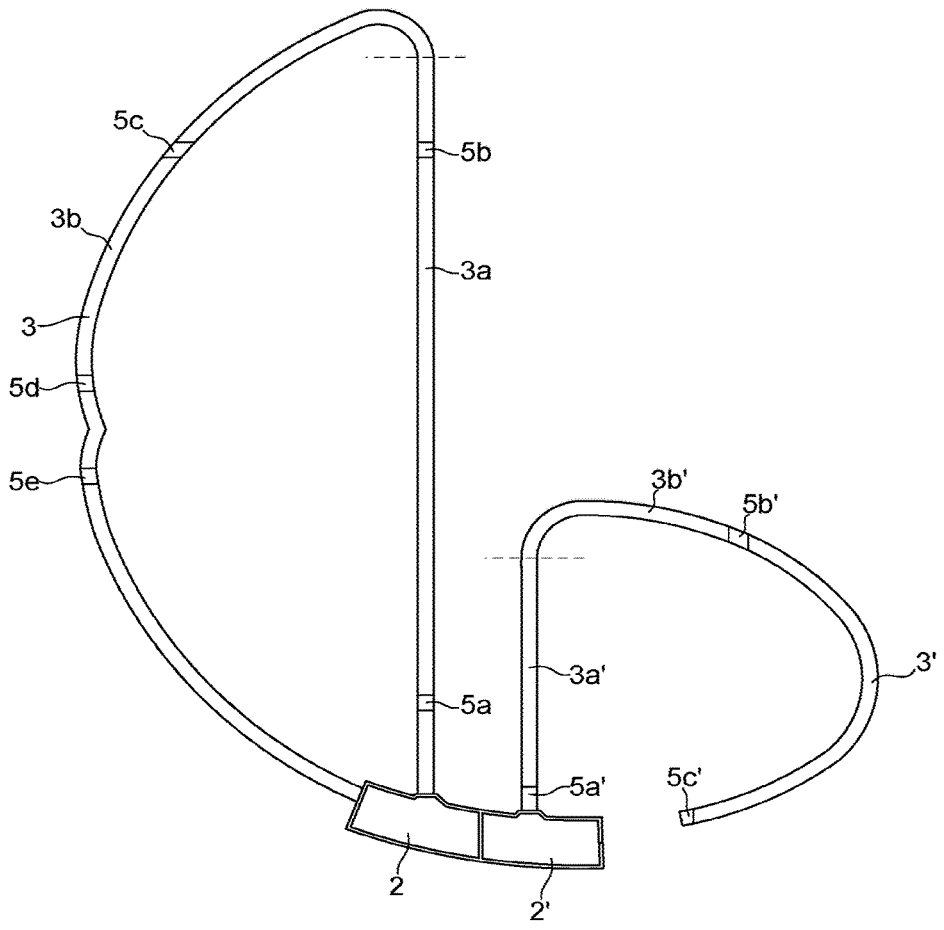
FIG. 4 shows a bottom view of an embodiment of gongs forming part of the striking mechanism according to the invention.

FIG. 4 shows an embodiment of an arrangement of two gongs 3, 3', which form part of the striking mechanism of a watch. Only the two gongs 3, 3' are represented in a bottom view and attached to a respective gong-carrier 2, 2', or to the same gong-carrier 2. The first gong 3 was described with reference to FIGS. 1 to 3 above and is the hour gong. The second gong 3' also includes a rectilinear part 3*a*' and a curved part 3*b*' and is the minute gong. First gong 3 is, for example, made longer than second gong 3'.

The two rectilinear parts 3*a*, 3*a*' of the two gongs 3, 3' of the striking mechanism are preferably arranged parallel to each other. However, the two rectilinear parts 3*a*, 3*a*' may also be disposed at a certain angle with respect to each other. The curved part 3*b* of first gong 3 extends from a free end of rectilinear part 3*a* in an opposite direction to the curved part 3*b*' of second gong 3', which extends from a free end of its rectilinear part 3*a*'. Rectilinear parts 3*a*, 3*a*' and curved parts 3*b*, 3*b*' are preferably disposed in the same plane, which is parallel to a watch dial, as shown below.

First gong 3 is preferably attached by both ends to gong-carrier 2, whereas second gong 3' is only attached to gong-carrier 2' by one end of rectilinear part 3*a*'. The other end of second gong 3', which is an end of curved part 3*b*', is free. However, it is also possible to envisage attaching second gong 3' by its curved part 3*b*' to gong-carrier 2' and leaving one end of rectilinear part 3*a*' free.

As a non-limiting example embodiment of such an arrangement of two gongs 3, 3' for a watch striking mechanism, it is possible to make these gongs 3, 3' in a precious metal, for example grey gold. Gongs 3, 3' are preferably made in the form of a strip with a rectangular cross-section. They may form one piece with gong-carrier 2.

First gong 3 may have a rectilinear or linear part 3*a* of a length comprised between 25 mm and 35 mm, for example around 30.1 mm, and a curved part 3*b* in the shape of an arc of a circle of a radius comprised between 15 mm and 20 mm, for example around 17.3 mm. The portion 3*c* modified purely from an aesthetic point of view is made in two radii of 7 mm and 3.7 mm in the median portion of curved part 3*b*. The width of gong 3 may be comprised between 0.5 mm and 1 mm, preferably 0.6 mm and is preferably identical from one end of first gong 3 to the other. The general thickness of gong 3 may also be identical over its entire length and comprised between 0.2 mm and 0.4 mm, for example 0.25 mm for first gong 3.

For first gong 3, two notches 5*a* and 5*b* are made in rectilinear part 3*a*, and three notches 5*c*, 5*d* and 5*e* in curved part 3*b*. Notches 5*a* to 5*e* or grooves are made over the entire width of first gong 3 and all have a length comprised between 1 and 2 mm, preferably 1.2 mm each. Each notch can be made with the same depth between 0.1 mm and 0.2 mm, preferably 0.15 mm for the first gong with a thickness of 0.25 mm.

The first notch 5*a* made in rectilinear part 3*a* is disposed between 3 mm and 5 mm, preferably 3.9 mm, away from the attachment to gong-carrier 2 of rectilinear part 3*a*, whereas second notch 5*b* is disposed between 22 mm and 26 mm, preferably 24.1 mm away. Third notch 5*c* made in curved part 3*b* is disposed between 22 mm and 26 mm, preferably 24.7 mm away from the attachment to gong-carrier 2 of rectilinear part 3*a* according to a perpendicular view from the rectilinear part 3*a*. Fourth notch 5*d* is made on modified portion 3*c* of curved part 3*b* and disposed between 14 mm and 17 mm, preferably at 15.4 mm from the attachment to gong-carrier 2 of rectilinear part 3*a* according to a perpendicular view from the rectilinear part 3*a*. Finally, fifth notch 5*e* is disposed between 8 mm and 12 mm, preferably at 9.9 mm from the attachment to gong-carrier 2 of rectilinear part 3*a* according to a perpendicular view from the rectilinear part 3*a*.

Depending on their positions in first gong 3, the purpose of notches 5*a* to 5*e* is to tune the gong so that its frequencies are close to those of the desired note, for example F sharp. This also allows the number of frequencies to be increased with the partials to enrich the sound produced by the vibrating gong. Their positions are optimised so that the frequency deviation between two consecutive frequencies of the gong is sufficient to prevent any risk of beats and/or dissonance in the sound produced.

As a result of this geometry of first gong 3, two frequencies comprised between 1.5 kHz and 5 kHz were optimised to approach F #5 and F #6 as mentioned in the above table. These frequencies are selected between 1 kHz and 5 kHz so that watch wearer's ear can differentiate the tone of a sound. Thus, at least two natural vibration frequencies are adapted within an audible range between 1 kHz and 5 kHz. Further, the ratio between these two frequencies is a number N+d, where N is an integer number greater than or equal to 2, and d/N is comprised between −0.01 and +0.01, so that the sound produced by the vibrating gong is harmonious.

For second gong 3', one notch 5*a*' is made in rectilinear part 3*a*', and two notches 5*b*' and 5*c*' in curved part 3*b*'. Notches 5*a*' to 5*c*' or grooves are made over the entire width of second gong 3'. Each notch can be made with the same depth of between 0.05 mm and 0.2 mm, preferably 0.1 mm for second gong 3' which has a thickness of 0.3 mm. Rectilinear part 3*a*' of second gong 3' may have a length comprised between 8 mm and 12 mm, for example around 10.3 mm, and a curved part 3*b*' in the shape of at least one arc of a circle with a radius comprised between 10 mm and 13 mm, for example around 11.7 mm. Preferably, the curved part is made with several radii and is not completely circular.

First notch 5*a*' made in rectilinear or linear part 3*a*' is disposed directly after the attachment to gong-carrier 2' of rectilinear part 3*a*'. This first notch 5*a*' may have a length of between 1 mm and 2 mm, preferably 1.6 mm. A second notch 5*b*' made in curved part 3*b*' is disposed between 6 mm and 8 mm with respect to the rectilinear part away from the connection of curved part 3b' to rectilinear part 3a'. The length of this second notch 5b' is between 1 mm and 2 mm, preferably 1.25 mm. Finally, the third notch 5c' is made at the free end of curved part 3b' and has a length comprised between 0.2 mm and 1 mm, for example 0.5 mm.

The lengths, depths and positions of these notches 5a' to 5c' of second gong 3' are coupled parameters to ensure proper tuning and a good vibrational response of the gong. In this configuration of second gong 3', there are two natural frequencies, which are optimised within the frequency band comprised between 1.5 kHz and 5 kHz, to approach the frequencies corresponding to B 5 and B 6.

It is also to be noted that the melodic tuning obtained between first hour gong 3 and second minute gong 3' thus corresponds exactly to a fourth.

Figure 5:
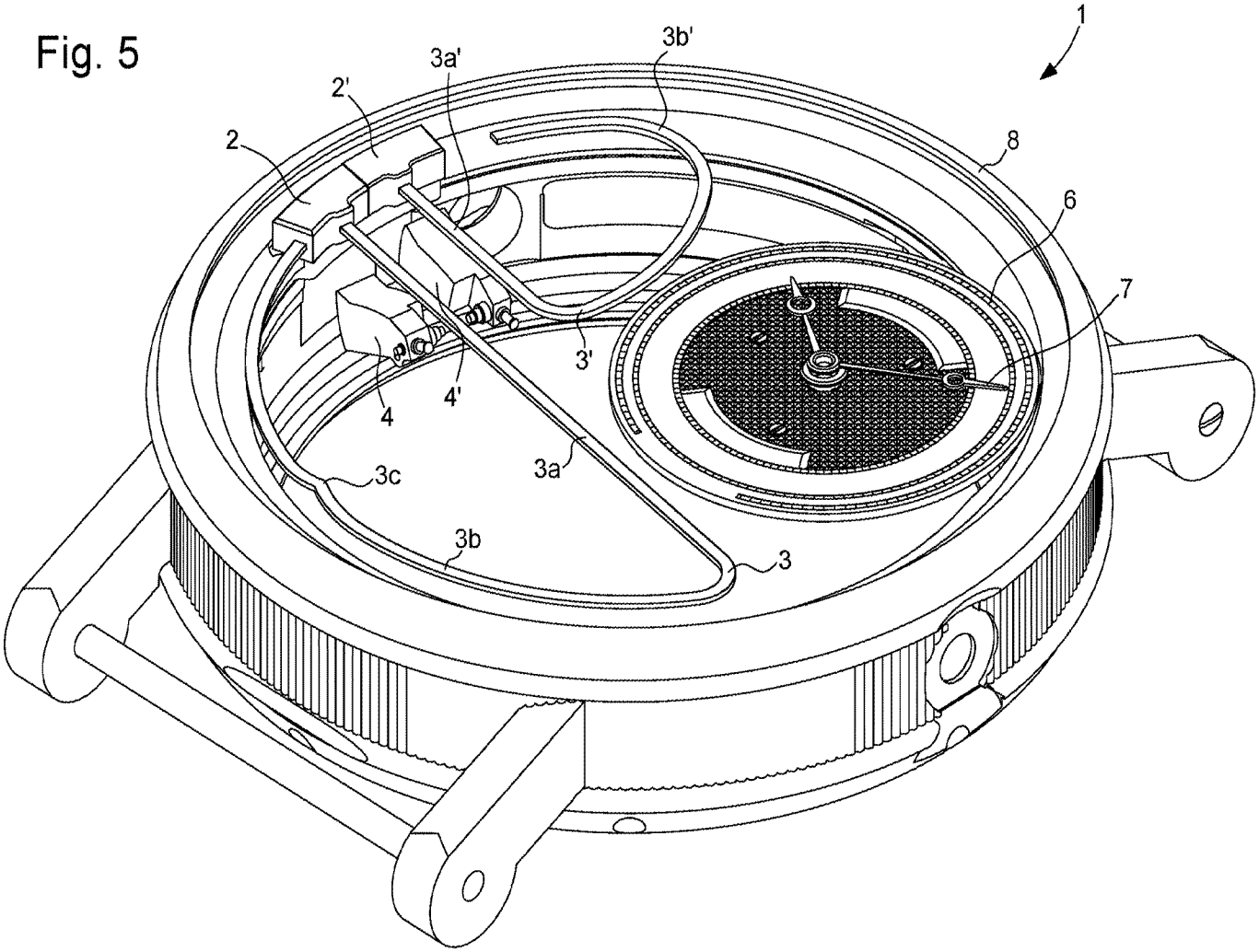
FIG. 5 shows a three-dimensional view of a watch with a striking mechanism which includes at least one gong as shown in FIG. 2 according to the invention.

FIG. 5 is a three-dimensional top view of a watch 1 with a striking mechanism. The watch includes a well-known watch or clock movement (not represented), which is disposed underneath a watch dial 6. Hands 7 for indicating the time rotate on said watch dial 6. The watch also includes a striking mechanism which may form part of the watch movement. This striking mechanism includes at least a first gong 3 attached to a gong-carrier 2, which is generally fixed on a main plate of the watch movement or arranged in contact with an inner wall of case middle 8 or the bezel or the back cover of watch case 1. The gong is generally a metal or metallic glass wire or strip. Gong 3 extends above the watch movement or parallel to watch dial 6. The mechanism also includes at least a first hammer 4 for striking gong 3 from below in a vertical direction Z, i.e. in a direction perpendicular to the plane defined by the gong or the watch movement on a watch plate.

Preferably, two gongs 3, 3' may be provided, attached to the same gong-carrier 2 or respectively to two gong-carriers 2, 2'. These first and second gongs 3, 3' are each intended to be struck by a respective hammer 4, 4'. The first hammer 4 is intended to strike the first gong 3 from below and in a vertical direction and preferably close to gong-carrier 2 on rectilinear part 3a of the gong. The second hammer 4', which is parallel to first hammer 4, is intended to strike the second gong 3' from below and in a vertical direction and preferably also close to gong-carrier 2' on rectilinear part 3a' of the gong.

As shown in detail in FIG. 5 of striking mechanism watch 1, the two hammers 4, 4' can be arranged to rotate about the same axis of rotation parallel to watch dial 6. These hammers 4, 4' can strike each gong 3, 3' at different or identical moments depending on the actuation thereof in the striking mechanism.

The two gongs 3, 3' can thus have two rectilinear parts 3a, 3a' extending in a diametral direction or a direction slightly offset from the centre of the watch, from the gong-carrier or gong-carriers 2, 2'. These gong-carriers 2, 2' are disposed close to or in direct contact with an inner wall of a case middle 8 or the bezel or the watch case back. These gong-carriers 2, 2' are preferably bonded to each other. Each gong 3, 3' includes a curved part 3b, 3b' starting at the free end of each rectilinear part 3a, 3a' and extending in an opposite direction to that of the other gong.

Of course, although not represented in FIG. 5, notches or hollows or grooves are made in an undersurface of each gong 3, 3' to tune the desired frequencies and produce a harmonious sound. These notches or hollows or grooves are advantageously not visible through a crystal of watch 1 (not represented) to maintain a good aesthetic appearance of visible gongs 3, 3.

From the description that has just been given, several variants of the unusual or atypical gong and the striking watch that contains it can be devised by those skilled in the art without departing from the scope of the invention defined by the claims. There may be a first gong attached to a first gong-carrier and a second gong attached to a second gong-carrier remote from the first gong-carrier and with both gongs in the same plane or in a different plane. The notches or hollows or grooves can be made in an undersurface of the gong or on the sides of the gong.

What is claimed is:

1. A gong for a striking mechanism of a watch, the gong comprising:

a wire or a strip including a rectilinear part connected to a curved part; and at least two notches or hollows or grooves at defined geometric points on a portion of a length thereof so as to adapt at least two natural vibration frequencies within an audible range between 1 kHz and 5 kHz, the notches or hollows or grooves formed on an undersurface of the gong such that the at least two notches or hollows or grooves are not visible on an upper surface of the gong located opposite the undersurface, wherein a ratio between the at least two frequencies is a number N+d, where N is an integer number greater than or equal to 2, and d/N is comprised between −0.01 and +0.01, so that a sound produced by the gong results in consonant harmonic and melodic intervals.

2. The gong according to claim 1, wherein the two notches or hollows or grooves are made in the rectilinear part.

3. The gong according to claim 1, wherein at least two notches or hollows or grooves are made in the curved part.

4. The gong according to claim 1, wherein at least two notches or hollows or grooves are made in the rectilinear part, and wherein at least three notches or hollows or grooves are made in the curved part of a circular shape in order to tune at least two natural vibration frequencies within the audible range from 1 kHz to 5 kHz.

5. The gong according to claim 1, wherein one notch or hollow or groove is made in the rectilinear part and wherein two notches or hollows or grooves are made in the curved part.

6. The gong according to claim 1, wherein each notch or groove is made over an entire width of the gong.

7. The gong according to claim 1, wherein two ends of the gong are intended to be attached to a single gong-carrier of the striking mechanism, and wherein the gong with the rectilinear part and the curved part thereof takes the form of a letter of the alphabet, a modified portion being defined in a median portion of the curved part.

8. The gong according to claim 1, wherein a thickness of a gong is identical over an entire length thereof, and wherein a depth of each notch or hollow or groove in a general thickness of the gong is identical.

9. A striking watch comprising a striking mechanism provided with at least one gong according to claim 1, the striking mechanism including at least one gong-carrier, to which the at least one gong is connected, and at least one hammer to strike, at determined moments, the at least one gong from below in a vertical direction substantially perpendicular to a plane including the at least one gong, the at least one gong-carrier being integral with a plate or disposed in contact with an inner wall of a case middle or a bezel or a watch case back.

10. The striking watch according to claim 9, wherein the at least one gong-carrier is attached in contact with an inner wall of a case middle or a bezel or a watch case back, wherein at least one end of the rectilinear part or of the curved part of the at least one gong is attached to the at least one gong-carrier, and wherein at least the upper surface of the at least one gong is visible through a crystal of the watch.

11. The striking watch according to claim 9, wherein the at least one gong includes a first gong and a second gong, the first gong to be struck by a first hammer from below and the second gong to be struck by a second hammer from below, wherein the first gong has two ends attached to the at least one gong-carrier, wherein the second gong has one end of the rectilinear part or of the curved part attached to the same gong-carrier or to a second gong-carrier disposed in contact with an inner wall of a case middle.

12. The striking watch according to claim 11, wherein the first gong and the second gong form only one piece with the at least one gong-carrier, wherein the rectilinear part of the first gong is disposed parallel to the rectilinear part of the second gong, the end of which is attached to the at least one gong-carrier, and wherein the two gongs are disposed in the same plane.

13. The striking watch according to claim 12, wherein the first gong includes at least two notches or grooves in the rectilinear part and at least three notches in the curved part, and wherein the second gong includes at least one notch or groove in the rectilinear part and at least two notches in the curved part.

14. A method for manufacturing the gong according to claim 1, for a striking mechanism of a watch, wherein the method comprises:

determining active lengths of the rectilinear part and of the curved part of the gong by dimensioning each part independently of the other to produce natural frequencies close to selected target values when the gong vibrates, and refining the natural frequencies of the gong by forming the notches or hollows or grooves at the defined geometric points on a length of the gong.

15. The method for manufacturing at least one gong according to claim 14, wherein the notches or hollows or grooves are made by milling in a general thickness of the gong over an entire width of the gong.

16. The method for manufacturing at least one gong according to claim 14, wherein the method comprises modifying a shape of the curved part of the gong on a median portion so as to define a structure in the shape of a letter.

17. A gong for a striking mechanism of a watch, the gong comprising:

a wire or a strip including a rectilinear part connected to a curved part; and at least two notches or hollows or grooves at defined geometric points on a portion of a length thereof so as to adapt at least two natural vibration frequencies within an audible range between 1 kHz and 5 kHz, the notches or hollows or grooves formed on an undersurface of the gong such that the at least two notches or hollows or grooves are not visible on an upper surface of the gong located opposite the undersurface, wherein a ratio between the at least two frequencies is a number N+d, where N is an integer number greater than or equal to 2, and d/N is comprised between −0.01 and +0.01, and wherein a cross-sectional area of the wire or strip is identical over an entire length thereof except where the notches or hollows or grooves are formed.

18. A gong for a striking mechanism of a watch, the gong comprising:

a wire or a strip including a rectilinear part connected to a curved part; and at least two notches or hollows or grooves at defined geometric points on a portion of a length thereof so as to adapt at least two natural vibration frequencies within an audible range between 1 kHz and 5 kHz, wherein a ratio between the at least two frequencies is a number N+d, where N is an integer number greater than or equal to 2, and d/N is comprised between −0.01 and +0.01, so that a sound produced by the gong results in consonant harmonic and melodic intervals, and wherein one notch or hollow or groove is made in the rectilinear part and wherein two notches or hollows or grooves are made in the curved part.

19. The gong according to claim 1, wherein each of the notches is placed on a gong length in correspondence with an antinode of one and only one of a mode shape.

* * * * *